US010171904B2

(12) United States Patent
Kyllönen et al.

(10) Patent No.: US 10,171,904 B2
(45) Date of Patent: Jan. 1, 2019

(54) WIRELESS NOSE-CANCELLING EARPLUG

(71) Applicant: QOn Oy, Kempele (FI)

(72) Inventors: Janne Kyllönen, Kiviniemi (FI); Matti Nisula, Oulu (FI); Pekka Sarlund, Hailuoto (FI)

(73) Assignee: QON OY, Kempele (FI)

( * ) Notice: Subject to any disclaimer, the term of this patent is extended or adjusted under 35 U.S.C. 154(b) by 0 days.

(21) Appl. No.: 15/524,743

(22) PCT Filed: Nov. 22, 2016

(86) PCT No.: PCT/FI2016/050818
§ 371 (c)(1),
(2) Date: May 5, 2017

(87) PCT Pub. No.: WO2017/089649
PCT Pub. Date: Jun. 1, 2017

(65) Prior Publication Data

US 2018/0005622 A1 Jan. 4, 2018

(30) Foreign Application Priority Data

Nov. 24, 2015 (FI) ..... 20155870

(51) Int. Cl.
*H04R 1/10* (2006.01)
*G10K 11/178* (2006.01)

(52) U.S. Cl.
CPC ..... *H04R 1/1058* (2013.01); *G10K 11/178* (2013.01); *H04R 1/1016* (2013.01);
(Continued)

(58) Field of Classification Search
CPC ..... G10K 11/178; G10K 2210/1081; G10K 2210/3044; H04R 1/1016; H04R 1/1058; H04R 2420/07
See application file for complete search history.

(56) References Cited

U.S. PATENT DOCUMENTS 8,989,424 B2 * 3/2015 Sibbald ..... H04R 1/10 381/371
2008/0107287 A1 5/2008 Beard
(Continued)

FOREIGN PATENT DOCUMENTS

GB 2 453 434 A 4/2009
WO WO-2006003618 A1 1/2006

OTHER PUBLICATIONS

Written Opinion of the International Searching Authority issued by the European Patent Office acting as the International Searching Authority in relation to International Patent Application No. PCT/FI2016/050818 dated Feb. 23, 2017 (7 pages).
(Continued)

*Primary Examiner* — Jason R Kurr
(74) *Attorney, Agent, or Firm* — Robert P. Michal, Esq.; Carter, DeLuca, Farrell & Schmidt, LLP

(57) ABSTRACT

A wireless noise-cancelling earplug includes a housing within which at least an active noise cancellation (ANC) circuit for producing anti-noise, a speaker for emitting the anti-noise as a sound wave, and a battery for powering at least the ANC circuit. The earplug further includes an audio cavity for guiding the sound wave from the speaker out of the earplug, at least one microphone for measuring ambient noise and feeding the measured ambient noise to the ANC circuit, and a passive noise reduction unit for blocking ambient noise.

18 Claims, 2 Drawing Sheets

(52) U.S. Cl.
CPC ... *H04R 1/1083* (2013.01); *G10K 2210/1081* (2013.01); *G10K 2210/3044* (2013.01); *H04R 2420/07* (2013.01); *H04R 2460/01* (2013.01)

(56) References Cited

U.S. PATENT DOCUMENTS

| | | | | |
|---|---|---|---|---|
| 2008/0152160 | A1 | 6/2008 | Chew et al. | |
| 2009/0123010 | A1 | 5/2009 | Cano et al. | |
| 2011/0223864 | A1 | 9/2011 | Wai | |
| 2011/0257469 | A1 | 10/2011 | Connor | |
| 2013/0121518 | A1 | 5/2013 | Dahl | |
| 2015/0139474 | A1* | 5/2015 | Henry | H04R 1/1016 381/380 |
| 2016/0232889 | A1* | 8/2016 | Baker | G10K 11/1788 |
| 2017/0094386 | A1* | 3/2017 | Trainer | H04R 1/1016 |

OTHER PUBLICATIONS

International Search Report issued by the European Patent Office acting as the International Searching Authority in relation to International Patent Application No. PCT/FI2016/050818 dated Feb. 23, 2017 (4 pages).

Finnish Search Report issued by the Finnish Patent and Registration Office in relation to Finnish Patent Application No. 20155870 dated Feb. 22, 2016 (2 pages).

Doppler Labs: "Here Active Listening—Change the Way You Hear the World", Jul. 1, 2015, XP055345207, Retrieved from the Internet: URL:https://www.kickstarter.com/projects/dopplerlabs/here-active-listening-change-the-way-youhear-the/description [retrieved on Feb. 13, 2017] (20 pages).

Communication Pursuant to Article 94(3) EPC issued by the European Patent Office in relation to European Application No. 16 810 440.4 dated Sep. 19, 2018 (7 pages).

G.R.A.S. Sound & Vibration A/s: "G.R.A.S. 45BC-1 KEMAR Head & Torso with Mouth Simulator for Headset Test, 2-Ch LEMO", Oct. 7, 2015, XP055505887, Retrieved from the Internet: URL:https://web.archive.org/web/20151007201404/http://www.gras.dk: 80/45bc-1.html [retrieved on Sep. 10, 2018] (5 pages).

"Electroacoustics—Simulators of human head and ear—Part 7: Head and torso simulator for acoustic measurement of hearing aids", IEC TS 60318-7:2011, IEC, 3, Rue De Varembé, PO Box 131, CH-1211 Geneva 20, Switzerland, Feb. 24, 2011, pp. 1-35, XP082001568, [retrieved on Feb. 24, 2011] (38 pages).

* cited by examiner

WIRELESS NOSE-CANCELLING EARPLUG

CROSS-REFERENCE TO RELATED APPLICATIONS

This application is a National Phase Entry under 35 USC § 371 of PCT Patent Application Ser. No. PCT/FI2016/050818 filed Nov. 22, 2016, which claims priority to Finnish Patent Application No. 20155870, filed Nov. 24, 2015, the disclosure of each of these applications is expressly incorporated herein by reference in their entirety.

TECHNICAL FIELD

The present disclosure relates to earplugs. Particularly, the present disclosure relates to wireless noise cancelling earplugs.

BACKGROUND

Earplugs are used in various situations where protection against or alleviation of outside noise is required. In many situations there is a need for earplugs that are small, easy to use and affordable and, at the same time, effective in cancelling noises of different frequencies.

For example, cabin noise in airplanes is a phenomenon of fairly low frequencies where the peak is around 70 Hz, and the peak cabin noise at this frequency can be as high as 90 dB. This can be especially stressful and annoying when trying to sleep during a flight, or when simply trying to relax in a noisy environment.

Also music, speech or other noise coming through walls of an apartment may create a stressful environment where attenuation of the unwanted noise is needed, especially during night time when the person suffering from the noise is trying to sleep or rest. The attenuation of such noise of fairly low frequencies would be desired.

The audio environment inside a motorcycle helmet of a motorist whilst riding has similar conditions, as well, which makes listening to radio and/or music while riding uncomfortable, as unwanted noise frequencies interfere or disrupt those of the desired audio input.

Earplugs with passive noise reduction are typically relatively cheap, simple structures made of foam plastic, memory foam, silicone, coated wax or other such malleable materials suitable for moulding in one's hands and inserting into one's ear canal where they subsequently expand to fill out the ear canal to passively reduce the noise reaching the audio organs. They do not offer very good protection against noise in the above-described situations. While their noise reduction capability increases with noise frequency, it is not particularly good at low frequencies.

On the other hand, active noise cancellation (ANC) works well at low frequencies, utilising a microphone for detecting noise, a Digital Signal Processor (DSP) or other signal processing equipment such as an analogue filter for processing the noise, and a speaker for producing antinoise cancelling the noise to be controlled. Commonly, ANC solutions utilise feedback or feed-forward topologies, or a combination of the two. In most embodiments ANC devices work well for noise with frequency 1 kHz or less. In addition, the present solutions for active noise cancellation can be relatively expensive and/or so cumbersome in their size and design that their use in the above-described situations is not feasible. Typically, ANC solutions are utilised in earplugs or headphones designed particularly for listening to music, and they are not suitable for sleeping or resting one's head against a pillow or a headrest.

Large earphones, or earplugs that extend from the ear beyond the tragus, antitragus and antihelix of the ear can well be worn when the user is standing, sitting or lying on his/her back. However, such earphones or earplugs are uncomfortable to wear when lying sideways or wearing head protection such as a helmet.

SUMMARY

There is provided wireless noise-cancelling earplug comprising a housing within which at least an active noise cancellation ANC circuit for producing anti-noise, a speaker for emitting the anti-noise as a sound wave, and a battery for powering at least the ANC circuit are arranged; the earplug further comprising an audio cavity for guiding the sound wave from the speaker out of the earplug, at least one microphone for measuring ambient noise and feeding the measured ambient noise to the ANC circuit, and a passive noise reduction unit for blocking ambient noise, the earplug characterised in that the earplug and the housing as viewed from one side is L-shaped comprising a stem portion of the L-shaped housing along a first axis and bar portion of the L-shaped housing along a second axis, wherein the stem portion has a length of 25 mm or less; the bar portion has a length of 23 mm or less; and an inner angle between the first axis and the second axis of the L-shaped housing is 85 to 120 degrees.

In one embodiment there is provided a noise cancelling earplug employing both passive and active noise cancellation. In an embodiment the earplugs are implemented so as to be affordable, and with noise cancellation that fits inside the user's ear. In an embodiment the earplugs requires no external power source while in use, but have a battery as power source that can be charged from time to time. In an embodiment the earplug reduces both high and low frequency noise, and is easy to use, and therefore overcomes or at least reduces the problems associated with the prior solutions as discussed above.

In one embodiment there is provided a convenient and user-friendly earplug comprising ANC, in which the number of user-operable components, such as switches or other controlling equipment, is avoided or minimised. In one embodiment, when the earplug is in use it has no disturbing or obtrusive power lines or cords. In an embodiment the earplug has its own power source in form of a rechargeable battery. Such a battery may be charged by connecting the earplug to a charger either via connectors, or it may be charged wirelessly, e.g. using inductive charging.

In an embodiment, there is provided an earplug having a size small enough to fit into the user's ear entirely. The entire earplug, apart from the bud part inserted into the ear canal, may be fitted into the concha and the intertragical notch of the user's outer ear, so that the earplug becomes situated between the tragus, the antitragus and the antihelix. This makes leaning against, for example, an airplane cabin seat headrest or a pillow more comfortable.

Herein the term 'earplug' means a device which is meant to be inserted at least partially into the ear canal of a user's ear to reduce noise. Earplugs are normally used as a pair, for both ears of the user.

Herein the term 'housing' means the outer casing or body of the earplug, which housing encompasses, protects and covers all pieces or some of the pieces of the electronic equipment of the earplug. In an embodiment the 'housing' may also provide the earplug its outer shape and design.

However, in some embodiments a separate cover may be provided on top of the housing where the cover provides the outer shape and design of the earplug.

Herein the term 'sealing bud' means a part of an earplug which is meant to be inserted into the ear canal of the user. In an embodiment the sealing bud may act as passive noise reduction equipment. In one embodiment the sealing bud may be separate from the housing. In another embodiment the sealing bud may be an integrated part of the housing.

Herein the term 'Digital Signal Processor' or 'DSP' means a microprocessor that is used for digital signal processing.

Herein the term 'active noise cancellation' or 'ANC' means active cancellation of certain frequencies of noise by producing antinoise or counteracting noise. The ANC may be implemented electronically.

In one embodiment high frequency noise includes noise of a frequency higher than 1 kHz. In another embodiment high frequency noise includes noise of a frequency higher than 2 kHz. In an embodiment high frequency noise may extend to 10 kHz and even above that.

Correspondingly low frequency noise includes in one embodiment noise of frequency under 1 kHz, and in another embodiment noise of frequency 2 kHz and less.

In one embodiment, the speaker is arranged into the intersection of the first axis and the second axis; and the housing comprises along the first axis at least the speaker and the battery; and along the second axis at least the speaker and the at least one microphone.

In one embodiment, the earplug comprises at one end of the housing along the first axis a sealing bud, wherein the length of the bar portion includes the dimension of the housing and the sealing bud along the first axis.

In one embodiment, the audio cavity comprises a first part arranged inside the housing along the second axis, and a second part arranged to protrude from the housing along a third axis, so that an inner angle between the first axis and the third axis is 85-110 degrees.

In one embodiment, the housing (12) comprises a first cylindrical part arranged along the first axis so that the normal axis of the first cylindrical part is substantially perpendicular to the first axis; a second cylindrical part whose axis is the second axis; a first surface which is the top circular plane surface of the first cylindrical part and which is parallel to the first axis and opposite the audio cavity; and a second surface, which is the bottom circular plane surface of the first cylindrical part and which is parallel to the second axis and on the same side as the audio cavity.

In one embodiment, the battery is arranged within the housing inside the first cylindrical part of the housing.

In one embodiment, at least the active noise cancellation ANC circuit, the speaker and the first part of the audio cavity are arranged within the second cylindrical part.

In one embodiment, the at least one microphone is arranged into the audio cavity.

In one embodiment, at least one microphone is arranged outside the audio cavity and the housing.

In one embodiment, the thickness of the earplug on the part of the stem portion that does not intersect with the bar portion is 5-9 mm.

In one embodiment, the width of the earplug on the part of the stem portion that does not intersect with the bar portion is 13-16 mm.

In one embodiment, the housing comprises charging sockets arranged on the first surface of the housing on the stem portion.

In one embodiment, the ANC circuit is configured to cancel noise at frequencies of 1 kHz or less.

In one embodiment, the earplug is intended to be placed into the ear so that the bar portion is placed in direction of and at least partly inside the ear canal, and the stem portion extends from the ear canal to the concha.

In one embodiment, the earplug is intended to fit in its entirety within a space inside the outer ear so that the passive noise reduction part fits into the outermost part of the ear canal and the housing fits into a space comprising the concha and the intertragical notch, and so that a first surface of the housing is situated below a plane defined by the tragus, the antitragus and the antihelix.

In one embodiment, the earplug reduces a wide range of noise frequencies, from around 0 Hz up to 10 kHz and above. In one embodiment, the earplug reduces noise from a frequency of 12 Hz. Typically, the auditory threshold of humans varies from 16 to 20 Hz. In one embodiment the earplugs comprise both passive and active noise cancellation components. The earplugs may reduce 90 dB noise level down to 50 dB. For some frequencies the earplugs may reduce around 85 dB noise level down to 40 dB. For some frequencies the earplugs may reduce around 70 dB noise level down to 30 dB. For some frequencies, the reduction in noise level may be 36 dB. For some frequencies a noise of around 50 dB may be reduced to 0 dB or close to 0 dB, and may thus be cancelled practically entirely.

In one embodiment, the earplug small enough to fit into the user's ear entirely, so that leaning against a pillow or a headrest during sleep or rest is more comfortable and may be possible without the earplug dropping out of the ear e.g. during sleep. Such earplugs may be used inside a tight helmet such as a motorcycle helmet.

In one embodiment, the earplugs do not require an outside power source while in use, but operate on a battery. In one embodiment the battery together with the ANC circuit is configured to operate at least 25 hours, or at least 7 hours. Such an operation period is typically sufficient to last for a night sleep or a long-distance flight.

BRIEF DESCRIPTION OF DRAWINGS

The accompanying drawings, which are included to provide a further understanding of earplug, and which constitute a part of this specification, illustrate embodiments of the earplug. Together with the description the drawings are meant to help to explain the principles of the earplug. The earplug is not limited to the specific embodiments illustrated in the drawings.

In the drawings.

DETAILED DESCRIPTION OF THE EMBODIMENTS

Figure 1:
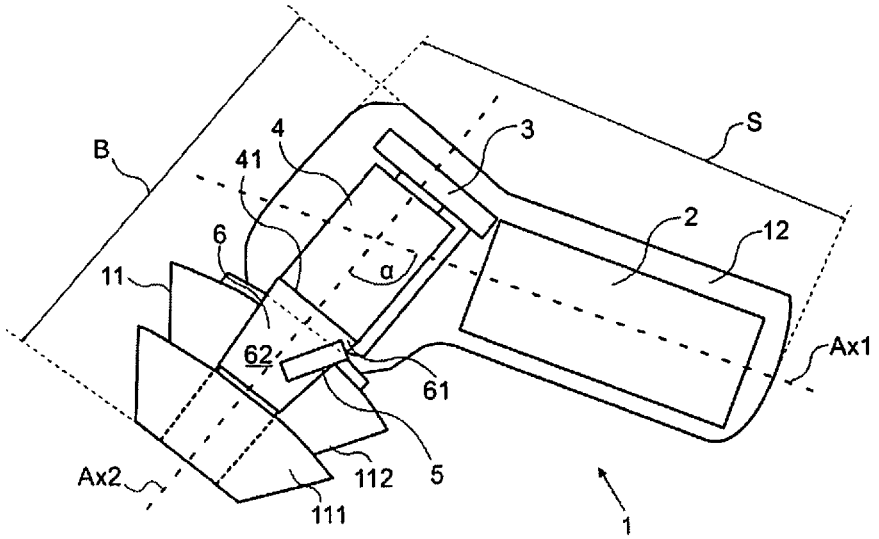
FIG. 1 presents a simplified sectional view of an earplug according to the present disclosure.

FIG. 1 is a schematic sectional view of an earplug 1, in accordance with an example embodiment. It is understood that the earplug 1 as illustrated and hereinafter described is merely illustrative of an earplug that benefit from the embodiments of the disclosure and, therefore, should not be taken to limit the scope of the disclosure. In an embodiment, the earplug 1 may be adapted merely to reduce noise. In another embodiment, the earplug 1 may be adapted with audio listening capability.

Figure 2:
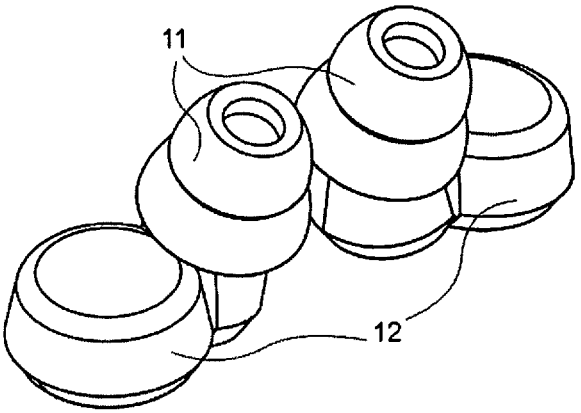
FIG. 2 presents an axonometric projection of a pair of earplugs.

A user would normally use a pair of earplugs 1, but for the sake of simplicity, the following description deals with one earplug 1 (for the right ear) only. Since a pair of earplugs is intended to be used in the left and right ear of the user, the earplugs 1 may be implemented as mirror images of each other. From the point of view of the functions, structure and design, the two earplugs need not differ from each other otherwise, as can be seen in FIG. 2*c*.

In at least one example embodiment, the earplug 1 comprises a housing 12 and an audio cavity 6. Inside the housing 12 there may be arranged a battery 2, an active noise cancellation (ANC) circuit 3 for producing anti-noise, and a speaker 4 for emitting the anti-noise as a sound wave. The earplug 1 may further comprise at least one microphone 5 for measuring ambient noise and feeding the measured ambient noise to the ANC circuit 3. The at least one microphone 5 may be situated in the audio cavity 6, outside the audio cavity 6, and/or outside the housing 12. The audio cavity 6 is intended for guiding the sound wave from the speaker 4 out of the earplug 1. There may be several microphones 5 arranged within the audio cavity 6 or within the housing 12 or outside both of them. The battery 2 is intended for powering at least the ANC circuit 3.

The earplug 1 and the housing 12, viewed from one side, may have an L-shaped form which comprises a stem portion S along a first axis Ax1 and a bar portion B along a second axis Ax2. The speaker 4 may be arranged into the intersection of the first axis Ax1 and the second axis Ax2. Along the first axis Ax1 may be arranged at least the speaker 4 and the battery 2. Along the second axis Ax2 may be arranged at least the speaker 4 and the microphone 5.

In at least one example embodiment, the housing 12 may be understood to comprise a first cylindrical part 120*a* arranged along the first axis Ax1 so that the normal axis of the first cylindrical part 120*a* is substantially transverse to the first axis Ax1; and a second cylindrical part 120*b* whose axis is the second axis Ax2. The first cylindrical part 120*a* and the second cylindrical part 120*b* may be joined together at an angle with a connector 120*c*. In another example embodiment the first cylindrical part 120*a* and the second cylindrical part 120*b* may be joined together at an angle by shape, wherein the housing 12 may be made from one mould so that the first cylindrical part 120*a* and the second cylindrical part 120*b* form integral parts.

In an embodiment, the housing 12 may further comprise a first surface 121*a*, which, when the earplug is placed in a user's ear, may be seen as the top circular plane surface of the first cylindrical part 120*a*. When the earplug 1 is in the user's ear the first surface 121*a* is an outer surface that can be seen when the earplug is in place.

The first surface 121*a* may be substantially parallel to the first axis Ax1, and arranged opposite the audio cavity 6. In an embodiment, a second surface 122, which, when the earplug is used, may function as the bottom circular plane surface of the first cylindrical part 120*a*, may be arranged opposite the first surface 121*a*, substantially parallel to the first axis Ax1, and on the same side as the audio cavity 6.

In an embodiment, a third surface 121*b* can be seen on top of the ear canal when the earplug is in the user's ear. The third surface 121*b* is the top circular plane surface of the second cylindrical part 120*b*.

In at least one example embodiment, a first part 61 of the audio cavity 6 is situated within the housing 12, along the second axis Ax2. A purpose of the first part 61 may be to connect a sound-emitting face 41 of the speaker 4 to a second part 62 of the audio cavity 6, which second part 62 extends outwards from the housing 12, along a third axis Ax3 (see FIG. 4*a*). This outwards extending second part 62 of the audio cavity 6 may be covered with a sealing bud 11. The second axis Ax2 may be also the axis of the speaker 4.

Figure 4A:
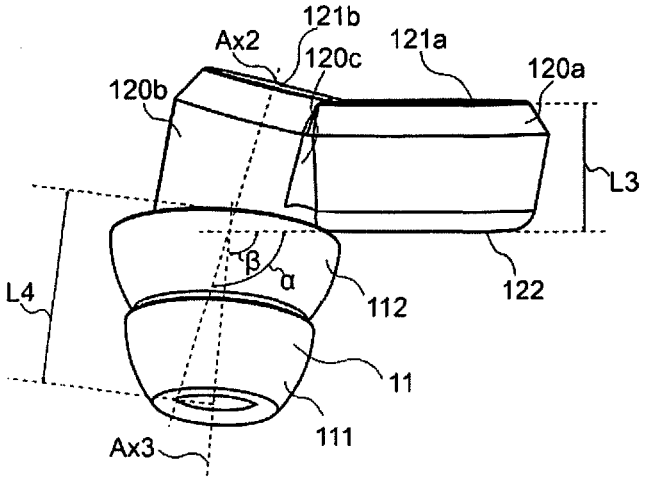
FIGS. 4*a-c* are further schematic presentations showing the dimensions of the earplug of a right ear.
Figure 4B:
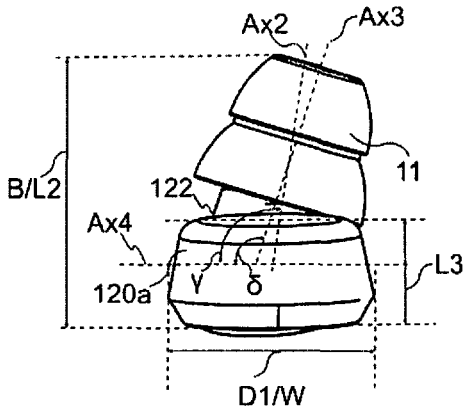

A fourth axis Ax4 is shown in FIG. 4*b*. This is an axis perpendicular to the Axis Ax1, and parallel to the first surface 121*a* and the second surface 122.

In at least one embodiment, the sealing bud 11 functions as a passive noise reduction part 11 for physically blocking ambient noise. In an embodiment, the sealing bud 11 is removable by e.g. pulling, and can be placed back onto the housing 12 e.g. by pushing. In another embodiment the sealing bud 11 forms an integral part of the housing 12.

In an embodiment, the dimensions of the audio cavity 6 are chosen to have a diameter as large as possible, however, without causing discomfort to the user when the earplug 1 is in place. The dimensions, for example the diameter, of the audio cavity 6 may depend on the diameter of the speaker 4. The first part 61 and the second part 62 of the audio cavity 6 may also have other than a circular cross-sectional shape.

In at least one example embodiment, the diameter of the first part 61 of the audio cavity 6 inside the housing 12 may be for example 4.24 mm, and the diameter may vary from 2 to 7 mm. In some example embodiments, the diameter of the first part 61 may be 3 mm, or 5.5 mm or 6.25 mm. The diameter of the second part 62 of the audio cavity 6 may be for example 2.5 mm, and the diameter may vary from 2 to 3 mm. In some example embodiments, the diameter of the second part 62 may be 2.2 mm, or 2.65 mm, or 2.8 mm.

A higher level of noise attenuation may be achieved with a larger audio cavity diameter together with a small front cavity volume of the speaker 4. In at least some embodiments, the volume of the first part 61 and the second part 62 of the audio cavity 6 are kept small, because acoustic capacitance may increase with increasing volume.

A very narrow audio cavity 6 may increase acoustic resistance and inductance when utilising impedance analogy where pressure equals voltage, and volume velocity equals current. Thus, in at least some example embodiments, a designer would seek a balance between a suitable acoustic capacitance and high enough noise attenuation.

In at least some example embodiments, the earplug has such a shape and size that the connection between the microphone 5 and the user's eardrum is straight. Such a straight connection may minimise or at least reduce resistance, inductance and capacitance by arranging the microphone 5 and the eardrum essentially in the same acoustic space. Forming a common acoustic space between the microphone and the user's eardrum may enable the production of desired anti-noise up to the eardrum. By desired anti-noise is herein meant anti-noise of such frequency so as to attenuate disturbing noise.

In at least one example embodiment, the earplug 1 comprises at one end of the housing 12, along the first axis Ax1 a sealing bud 11. The sealing bud 11 may be detachably connectable to the casing of the second part 62 of the audio cavity 6. In an embodiment, the second part 62 of the audio cavity and the sealing bud 11 have a common axis Ax3 which is illustrated in FIG. 4*a*.

In at least one example embodiment, the sealing bud 11 comprises a first conical flange part 111 and a second conical flange part 112 arranged on top of each other so that the first conical flange part 111 partly covers the second conical flange part 112. The second conical flange part 112 may be arranged to cover the second part 62 of the audio cavity 6 which is not situated within the housing 12 in order to achieve efficient acoustic attenuation of noise, sufficient sealing of the ear canal and comfortability for the user through a good fit in the ear canal. The double layer or double flange 111, 112 structure of the sealing bud 11 enables, in at least one example embodiment, the earplug 1 to be fitted tightly into the ear canal of the user so that the ear canal is effectively blocked off to enable attenuation of high frequency noise.

In at least one example embodiment, the sealing bud 11 may be made of silicone or other pliable, elastic and flexible material, such as memory foam or rubber. Such exemplary materials allow the sealing bud 11 to function as a passive noise reduction unit, and allow the insertion of the earplug 1 into the ear canal of a user. Such sealing bud materials may improve the conformation of the sealing bud 11 against the inner lining of the ear canal of a user to efficiently block out high frequency noise.

In at least one example embodiment, the earplug may be equipped (e.g. in the sales package) with sealing buds 11 of different sizes. Sealing buds of different sizes may be arranged to be sold separately as accessories. The user may select a sealing bud 11 in a size that best fits into his ear. The earplug may be arranged with sealing buds 11 of at least two different sizes (smaller and larger). Sealing buds 11 of different sizes may be of different colour or may have a letter (e.g. L for large, M for medium, S for small) to indicate size to the user.

By selecting a sealing bud 11 of suitable size the earplug 1 may, in at least one example embodiment, be inserted deep enough into the ear canal of the user's ear so as to avoid the outer surface 121*a*, 121*b* of the earplug (when in the ear) to extend further out of the ear than the tragus, antitragus and antihelix of the ear. This may not be possible for all users even with different sizes of sealing buds 11 due to different users having ears of different shape and size.

In one example embodiment, the length L4 (as illustrated in FIG. 4*a*) of the smaller sealing bud 11, may be 9.05 mm, in the vertical direction, i.e. in the direction of the ear canal. In one example embodiment the length L4 of the smaller sealing bud 11 may vary between 8 and 10 mm (see FIG. 4*a*). In some example embodiments, the length L4 of the smaller sealing bud 11 may be 8.25 mm, or 8.7 mm, or 9.75 mm. In one example embodiment, the length L4 of the larger sealing bud 11 may be 10.82 mm, in the vertical direction, i.e. in the direction of the ear canal. In one example embodiment the length L4 of the larger sealing bud 11 may vary between 9 and 12 mm. In some example embodiments, the length L4 of the larger sealing bud 11 may be 9.5 mm, or 10.2 mm, or 11.45 mm. The earplug 1, its sales package or a container for storing one or several earplugs may be arranged with sealing buds of one, two or more different sizes.

In an example embodiment, within the audio cavity 6, the at least one microphone 5 may be arranged in electrical connection with the ANC circuit 3. In an embodiment, the microphone 5 may be arranged into the first part 61 of the audio cavity 6. In at least one example embodiment the microphone 5 is arranged in the earplug in relation to the speaker 4 so that when the earplug 1 is inserted into the user's outer ear, the microphone 5 is situated in front of the speaker 4, i.e. closer to or deeper inside the ear canal.

In an embodiment, the speaker 4 is in electrical connection with the ANC circuit 3. In at least one example embodiment, the ANC circuit 3 is placed within the housing 12 so that it is located behind the speaker 4 as seen from inside the ear canal, i.e. is further away from the ear canal than the speaker 4. In an embodiment, the battery 2 is arranged into the part of the housing 12 that, when the earplug 1 is in place as described above, rests inside the concha of the user's outer ear.

In an embodiment, as seen in a vertical direction of the ear canal, the battery 2 is arranged next to the speaker 4 so that in the vertical direction of the ear canal the battery 2 is located on a similar distance from the ear canal as the speaker 4.

In one embodiment, the active noise cancellation circuit 3 is configured to cancel noise at frequencies of 1 kHz or less. In another exemplary embodiment, that the active noise cancellation ANC circuit 3 is configured to cancel noise at frequencies of 2 kHz or less.

There are various known methods or topologies for implementing an ANC circuit. In at least one example embodiment, the ANC may employ a known feedback method or feedback topology for noise cancellation. With such an example ANC implementation, the microphone 5 may be arranged into the acoustic space in the earplug so as to locate towards the inner ear when in use, as illustrated in FIG. 1, i.e. the microphone 5 is arranged within the audio cavity 6. The microphone 5 may be arranged along or in proximity of the second axis Ax2. In some example embodiments, the microphone 5 may be arranged in such a manner that at least a part of the microphone 5 intersects the second axis Ax2.

In an example embodiment, the ANC may employ a known feed-forward method or feed-forward topology for noise cancellation. With such an example ANC implementation, the microphone 5 is arranged into a space outside the ear and/or the earplug 1 when in use. In an example embodiment, "outside the ear and/or the earplug 1" means that the microphone 5 may be located into or below an audio opening arranged into the casing of the housing 12.

In an example embodiment, more than one microphone 5 may be employed with the feed-forward topology.

In an example embodiment, the ANC may employ a known combination or hybrid topology of the feedback and feed-forward methods/topologies. With such an example ANC implementation, at least two microphones 5 may be utilised, and they can be arranged either within the audio cavity 6, and/or outside the audio cavity 6, and/or outside the housing 12. In an example embodiment, "outside the housing 12" means that the microphone 5 may be located into or below an audio opening arranged into the casing of the housing 12.

With a known feedback method/topology implementation of the ANC circuit 3, the ANC circuit 3 may comprise an audio filter for filtering resonance peaks causing instability in the antinoise generation, thus improving the generation intensity of antinoise. An audio filter may comprise one or two or more, notch band stop filters for removing resonance derived from the speaker, the natural frequency of the ear canal and the so-called Helmholtz resonance of the audio cavity 6 of the earplug 1.

The audio filtering means may further comprise a lead-lag compensator for filtering infrasounds or for maintaining low frequency stability. Instability in the operation of the ANC manifests itself as oscillation, which may cause additional noises such as whistling or howling, humming, unpitched noise, or pops or clicks, disturbing to the user. The compensator may also be of the type lead, lag, PID or other with which a stable end result of infrasound filtering or low frequency stability maintaining can be achieved.

In at least one example embodiment, the battery 2 may be arranged within the housing 12 at least partly in the part of the stem portion S (of the L-shaped earplug) that does not intersect with the bar portion B (of the L-shaped earplug). In one example embodiment, at least part of the housing 12 on the stem portion S is a first cylindrically shaped part 120*a*, and the battery 2 is arranged within the first cylindrical part 120*a* in its entirety.

In an example embodiment, the housing 12 comprises charging sockets 8 arranged on the first surface 121*a* on the stem portion S, which is the upper surface of the earplug 1 as illustrated in FIG. 4*a*, i.e. when the L-shaped earplug is in a position where the stem portion S is in a horizontal position and the bar portion L is in a vertical position and facing downwards from the stem portion S.

In an embodiment, the battery 2 is rechargeable through the charging sockets 8. Such a placement of charging sockets 8 or charging pins 8 helps in avoiding skin contact with the charging sockets or pins 8 while the earplug 1 is in use and in place inside the outer ear, as the charging sockets 8 face outwards away from the outer ear.

In an example embodiment, the charging sockets 8 enable recharging the battery 2 with e.g. a separate external charger. In an embodiment, the charging sockets 8 are so formed that the earplug 1 can be easily positioned correctly onto charging spikes of an external charger. In an example embodiment, a cylindrically shaped Li-Ion battery 2 may be used. Li-Ion batteries exist of the suitable size and shape as to fit inside e.g. a housing 12 as the one illustrated in FIG. 1 with the exemplary dimensions provided herein, and that have enough energy to provide a sufficient operational period for the earplug 1. In an example embodiment, a sufficient operational period corresponds to a typical night's sleep, 7-9 hours, or to intercontinental flights of 10-14 hours.

In an embodiment, the operation time of the battery may be a minimum of 2 hours and may last even 50 hours in situations where the earplug 1 remains totally unmoved, i.e. if the user of the earplug 1 does not move his head. In an example embodiment and example use situation, the operation time may be 10-25 hours when the earplug 1 is in place and the user rests his head against a pillow or a headrest. In an example use situation, where the earplug 1 is subjected to constant movement, i.e. where the user keeps moving his head constantly or regularly, the operation time may be 7 hours.

In an embodiment, the external charger may also be utilised as a container for one or two earplugs 1 wherein charging plugs are arranged inside the container, and a charger may be connected to the container. In an example embodiment, the earplug 1 comprises a sensor for automatically activating, i.e. switching on the earplug and its ANC circuit and function, as soon as it is removed from its container. Examples of such a sensor are an ambient light sensor (ALS), a magnet (that may be provided in either or both the earplug and container), acceleration sensor. In an example embodiment, the earplug 1 comprises a sensor for automatically activating, i.e. switching on the earplug and its ANC circuit and function, as soon as it is placed in the ear if the user. Examples of such sensors are a proximity sensor and a camera, or another sensor that is capable of e.g. measuring the pulse of a human by sensing blood flow and thus sensing proximity of the earplug to the ear. Such a sensor may be arranged within or close to the sealing buds 11 (see e.g. FIG. 1) or at the surface 122 (see e.g. FIG. 4*a*).

In an example embodiment, the earplug 1 comprises an induction charging circuit. In such an embodiment no charging sockets or pins 8 are needed. The charger can in this case be an induction charger, such an induction charging pad onto which the earplug 1 is placed for charging the battery 2.

An example embodiment of the design of the earplug 1 is depicted in more detail in FIGS. 1, 3*a-b* and 4*a-c*.

In an example embodiment, the housing 12 of the earplug 1 is formed of the first cylindrical part 120*a* and the second cylindrical part 120*b*. These two may be joined together at a specific point of their circumference at an angle α with the wedge-shaped connecting part 120*c*.

As can be seen in FIG. 1 and FIG. 4*a*, the angle α is, in the illustrated example embodiment, the inner angle between 1) the second axis Ax2 of the second cylindrical part 120*b* as well as the speaker 4, and 2) the first axis Ax1, which is also the plane defined by the second surface 122 of the housing 12. In an example embodiment, the angle α may vary from 85 to 120°. In an example embodiment, the angle α is 107.94°. In some other example embodiments, the angle α may be 85.25°, or 89.85°, or 93.5°, or 97.75°, or 102°, or 115.55°.

Further, in an example embodiment the second cylindrical part 120*b* is angled (angle β) in relation to the first cylindrical part 120*a* in another direction, as can be seen in FIG. 4*a*. The angle β is the inner angle between 1) the third axis Ax3 of the second part 62 of the audio cavity 6, which is also the axis of the sealing bud 11, and 2) the first axis Ax1, which is also the plane defined by the second surface 122 of the housing 2. In an example embodiment, the angle β may vary from 85 to 110°. In an example embodiment, the angle β is 92.56°. In some other example embodiments, the angle β may be 87.25°, or 95°, or 97.55°, or 103°.

Seen from another projection (FIG. 4*b*) there is also an angle γ between 1) the second axis Ax2 which is the axis of the second cylindrical part 120*b* as well as the speaker 4, and 2) the fourth axis Ax4 which defines a plane parallel to the first surface 120*a* and the second surface 122. The angle γ defines the inclination of the second cylindrical part 120*b* in relation to the first cylindrical part 120*a*. In an example embodiment, the angle γ may vary from 90 to 125°. In an example embodiment, the angle γ is 99.35°. In some other example embodiments, the angle γ may be 92.5°, or 96°, or 102.75°, or 116.25°, or 119.7°.

Furthermore, there is also an angle δ between 1) the third axis Ax3 which is the axis of the sealing bud 11 as well as the second part 62 of the audio cavity 6, and 2) the fourth axis Ax4 or the second surface 122. The angle δ defines the inclination of the sealing bud 11, i.e. the passive noise-cancelling part of the earplug 1, in relation to the first cylindrical part 120*a*. In an example embodiment, the angle δ may vary from 90 to 125°. In an example embodiment, the angle δ is 107.63°. In some other example embodiments, the angle δ may be 92.5°, or 97°, or 101.75°, or 112.25°, or 118.5°.

As a result of the selected inclined relationships between the different parts (11, 120*b*, 120*a*) of the earplug 1, the earplug 1 may have an anatomically correct design, meaning that is suitable and comfortable in use. As the second part 62 of the audio cavity 6 (as well as the sealing bud 11) is angled in relation to the second cylindrical part 120*b* from which it is arranged to protrude. In an example embodiment, the angles γ and δ may be selected or chosen so as to enable comfortable fit into the concha of the outer ear of the user, when the sealing bud 11 is in place in the ear canal. In an example embodiment, having such an angle β in the earplug 1 allows the earplug to be placed within the ear so as to provide room for earplug within the concha and intertragical notch, as well as to the tragus.

Figure 3A:
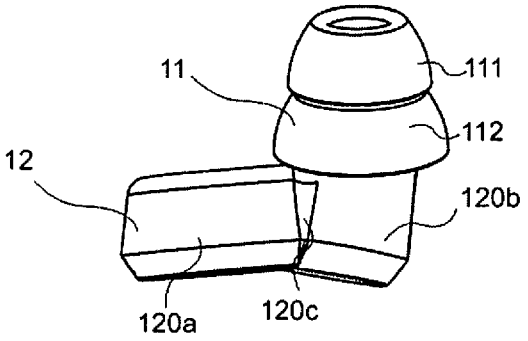
FIGS. 3*a* and 3*b* present the earplug in two different axonometric projections.
Figure 3B:
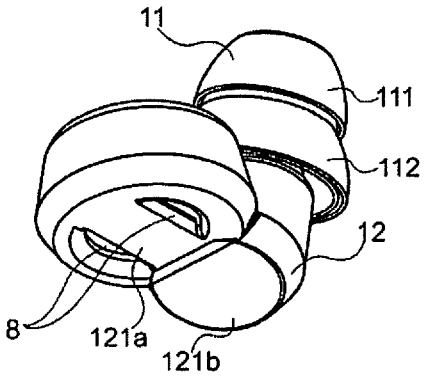
Figure 4C:
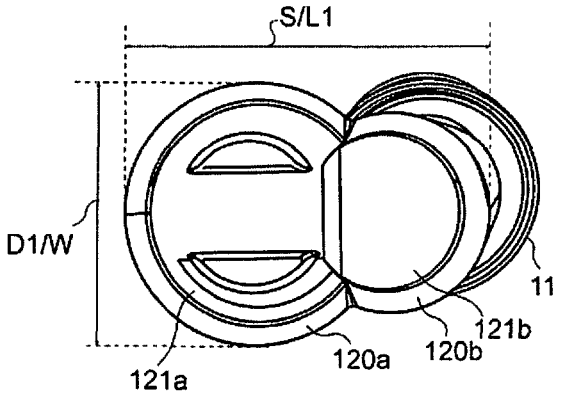

In FIG. 4*a-c*, dimensions of an example embodiment of the earplug 1 can be seen in more detail, in several different angles of view for the sake of clarity. The exemplary dimensions represent the dimensions of the earplug 1 so that when it is correctly placed inside the user's outer ear, the sealing bud 11 is inserted into the ear canal as far as it goes to ensure tight fit and efficient blocking off of the ear canal. The exemplary earplug 1 depicted in FIG. 3*a-c* is intended for the right ear.

In an example embodiment, the thickness L3 of the earplug 1, i.e. the thickness of the earplug 1 on the part of the stem portion S that does not intersect with the bar portion B, or the thickness of the first cylindrical part 120*a*, may be for 7.85 mm. In other example embodiments, the thickness L3 may vary from 5 to 9 mm (FIGS. 4*a, b*). In some example embodiments, the thickness L3 may be 6.25 mm, or 7 mm, or 8.55 mm.

In an example embodiment, the width W of the earplug 1 is the diameter D1 of the first cylindrical part 120*a*, i.e. the width of the earplug 1 on the part of the stem portion S that does not intersect with the bar portion B. In an example embodiment, the width W is 15.75 mm. In other example embodiments, the width W may vary from 13 to 16 mm (FIGS. 4*b, c*). In some example embodiments, the width W may be 13.5 mm, or 14.25 mm, or 15 mm.

In an example embodiment, the length L1 of the earplug is the length of the stem portion S, i.e. the measurement from the furthermost point on the perimeter of the first cylindrical part 120*a* to the furthermost point on the perimeter of the second cylindrical part 120*b* (FIG. 4*c*). In an example embodiment, the length L1 is 21.75 mm. In other example embodiments, the length L1 may vary from 17 to 25 mm. In some example embodiments, the length L1 may be 17.25 mm, or 19.55 cm, or 24.0 mm.

In an example embodiment, the length L2 of the bar portion B is the measurement from the first surface 121*b* of the second cylindrical part 120*b* to the outermost point of the sealing bud 11. In an example embodiment, this length L2 includes the dimensions of the housing 12 and the sealing bud 11 along the second axis Ax2. In an example embodiment, the length L2 is 19.79 mm, in case the user has selected a smaller sealing bud 11. In case a larger sealing bud 11 has been selected, the length L2 is in an example embodiment 21.56 mm. In other example embodiments, the length L2 may vary from 15 to 25 mm. In some example embodiments, the length L2 may be 16.55 mm, or 18.25 mm, or 21.05 mm, or 22 mm, or 23.75 mm.

In an example embodiment, the edges of the two cylindrical parts 120*a*, 120*b* may be rounded to ensure a comfortable fit inside the outer ear of the user. In an example embodiment, the edges between the first surface 121*a* of the housing 12 and the surface of the two cylindrical parts 120*a*, 120*b* may be bevelled. Such exemplary rounded or bevelled design may be beneficial in fitting the earplug 1 tightly but comfortably inside the outer ear, and may enable the earplug 1 to be inserted in its entirety into even a small ear, even when the structure of the user's ear is challenging (i.e. the crux helix is pronounced or situated low) so that when the earplug 1 is in the ear, the outer surfaces 121*a*, 121*b* remains within the borders of the ear created by the tragus, antitragus and the antihelix. The curved design of the outer contours of the housing 12 in an example embodiment allows the earplug 1 to be fitted against the antitragus of the outer ear.

In an example embodiment, the earplug 1 is inserted into place by pushing it into the outer ear and twisting it into place. In an example use situation, the earplug 1 is intended to be placed into the ear so that the bar portion B is placed in direction of and at least partly inside the user's ear canal, and so that the stem portion S extends from the ear canal to the concha. In an example embodiment, when the earplug 1 is properly in place inside the user's outer ear, the parts of the earplug 1 are situated as follows:

the passive noise reduction part is inserted into the ear canal by pushing it tightly into a place where the sealing bud 11 effectively closes off the ear canal, the second cylindrical part 120*b* extends outwards from the ear canal to the intertragical notch of the outer ear, the first cylindrical part 120*a* nests comfortably inside the concha of the outer ear, and the first and third surfaces 121*a*, 121*b* end up situated below a plane defined by the tragus, the antitragus and the antihelix of the outer ear.

In this exemplary placement, the earplug 1 is situated completely inside the outer ear, i.e. no parts of the earplug 1 protrude outward or past the level defined by the tragus, the antitragus and the antihelix. This allows the user may comfortably rest his head and ear against a pillow or a headrest or similar without discomfort or pressure to the ear or head from the earplug 1 against the headrest. Furthermore, such an exemplary placement ensures that the earplug 1 cannot easily fall out from the outer ear.

The above embodiments are to be understood as illustrative examples of the earplug. Further embodiments of the earplug can be conceived. It is to be understood that any feature described herein in relation to any one embodiment may be used alone, or in combination with other features described, and may also be used in combination with one or more features of any other of the embodiments, or any combination of any other of the embodiments. Furthermore, equivalents and modifications not described above may also be employed within the scope of the accompanying claims.

The invention claimed is:

1. A wireless noise-cancelling earplug comprising:

a housing comprising a first cylindrical part and a second cylindrical part, within which an active noise cancellation (ANC) circuit is configured to produce anti-noise, a speaker is configured to emit the anti-noise as a sound wave, and a battery is configured to power the ANC circuit;

a sealing bud disposed about a portion of the second cylindrical part of the housing, the sealing bud and the housing forming a passive noise reduction unit configured to fully occlude an ear canal;

an audio cavity configured to guide the sound wave from the speaker out of the earplug;

at least one microphone configured to measure ambient noise and to feed the measured ambient noise to the ANC circuit, wherein the earplug and the housing as viewed from one side is L-shaped comprising a stem portion that extends between outer extremities of the housing along a first axis and a bar portion that extends between an outer extremity of the housing and an outermost point of the passive noise reduction unit, wherein:

the stem portion has a length of 25 mm or less;

the bar portion has a length of 23 mm or less; and an inner angle between the first axis and the second axis is 85 to 120 degrees, wherein at least the ANC circuit, the speaker, and a first part of the audio cavity are arranged within the second cylindrical part.

2. The earplug according to claim 1, wherein:

the speaker is arranged at the intersection of the first axis and the second axis;

the battery is arranged along the first axis; and the at least one microphone is arranged along the second axis.

3. The earplug according to claim 1, wherein:

the sealing bud disposed about one end of the housing and arranged along the second axis, wherein the length of the bar portion includes the dimension of the housing and the sealing bud along the second axis.

4. The earplug according to claim 1, wherein the audio cavity comprises a first part arranged inside the housing along the second axis, and a second part arranged to protrude from the housing along a third axis, so that an inner angle between the first axis and the third axis is 85-110 degrees.

5. The earplug according to claim 1, wherein the first cylindrical part is arranged along the first axis so that the normal axis of the first cylindrical part is substantially perpendicular to the first axis; the second cylindrical part whose axis is the second axis; a first surface which is the top circular plane surface of the first cylindrical part and which is parallel to the first axis and opposite the audio cavity; and a second surface, which is the bottom circular plane surface of the first cylindrical part and which is parallel to the first axis and on the same side as the audio cavity.

6. The earplug according to claim 5, wherein the battery is arranged within the housing inside the first cylindrical part.

7. The earplug according to claim 1, wherein the at least one microphone is arranged inside the audio cavity.

8. The earplug according to claim 1, wherein the at least one microphone is arranged outside the audio cavity and the housing.

9. The earplug according to claim 1, wherein the thickness of the earplug on the part of the stem portion that does not intersect with the bar portion is 5-9 mm.

10. The earplug according to claim 1, wherein the width of the earplug on the part of the stem portion that does not intersect with the bar portion is 13-16 mm.

11. The earplug according to claim 1, wherein the housing comprises charging sockets arranged on the first surface of the housing on the stem portion.

12. The earplug according to claim 11, wherein the earplug is intended to fit in its entirety within a space inside the outer ear so that the sealing bud fits into the outermost part of the ear canal and the housing fits into a space comprising the concha and the intertragical notch, and so that the first surface and a third surface are situated below a plane defined by the tragus, the antitragus, and the antihelix.

13. The earplug according to claim 1, wherein the ANC circuit is configured to cancel noise at frequencies of 1 kHz or less.

14. The earplug according to claim 1, wherein the earplug is intended to be placed into the ear so that the bar portion is placed in direction of and at least partly inside the ear canal, and the stem portion extends from the ear canal to the concha.

15. A wireless noise-cancelling earplug comprising:

a housing comprising a first cylindrical part and a second cylindrical part, within which an active noise cancellation (ANC) circuit is configured to produce anti-noise, a speaker is configured to emit the anti-noise as a sound wave, and a battery is configured to power the ANC circuit;

a sealing bud disposed about a portion of the second cylindrical part of the housing, the sealing bud and the housing forming a passive noise reduction unit configured to fully occlude an ear canal;

an audio cavity configured to guide the sound wave from the speaker out of the earplug;

at least one microphone configured to measure ambient noise and to feed the measured ambient noise to the ANC circuit, wherein the earplug and the housing as viewed from one side is L-shaped comprising a stem portion that extends between outer extremities of the housing along a first axis and a bar portion that extends between an outer extremity of the housing and an outermost point of the passive noise reduction unit, and wherein at least the ANC circuit, the speaker, and at least a first part of the audio cavity are arranged within the second cylindrical part.

16. The earplug according to claim 15, wherein the stem portion has a length of 25 mm or less.

17. The earplug according to claim 15, wherein the bar portion has a length of 23 mm or less.

18. The earplug according to claim 15, wherein an inner angle between the first axis and the second axis is 85 to 120 degrees.

* * * * *